US005763371A

United States Patent [19]

Debska-Chwaja et al.

[11] Patent Number: 5,763,371

[45] Date of Patent: Jun. 9, 1998

[54] ETHYLENE COMPRESSOR LUBRICANT CONTAINING PHOSPATE ESTER OF A MONOGLYCERIDE OR DIGLYCERIDE

[75] Inventors: Anna Debska-Chwaja, Suffern, N.Y.; Albert Benson, Fairlawn; Paul G. Tietze, Oak Ridge, both of N.J.

[73] Assignee: Witco Corporation, Greenwich, Conn.

[21] Appl. No.: 733,541

[22] Filed: Oct. 18, 1996

Related U.S. Application Data

[63] Continuation of Ser. No. 592,622, Jan. 26, 1996, abandoned, which is a continuation of Ser. No. 282,975, Jul. 29, 1994, abandoned.

[51] Int. Cl.[6] ..... C10M 141/10

[52] U.S. Cl. ..... 508/429; 508/430; 508/440; 252/68

[58] Field of Search ..... 508/429, 440, 508/430; 252/68

[56] References Cited

U.S. PATENT DOCUMENTS

| | | | |
|---|---|---|---|
| 2,261,047 | 10/1941 | Asseff | 252/35 |
| 2,340,073 | 1/1944 | Morgan | 252/49.8 |
| 2,340,331 | 2/1944 | Knutson | 252/56 R |
| 2,373,733 | 4/1945 | Adams | 252/56 R |
| 2,389,513 | 11/1945 | Kemp | 252/49.8 |
| 2,400,120 | 5/1946 | Julian | 252/49.9 |
| 2,413,353 | 12/1946 | Hunter | 252/49.8 |
| 2,414,263 | 1/1947 | Kemp | 252/49.8 |
| 2,498,628 | 2/1950 | Cyphers | 252/49.8 |
| 2,549,270 | 4/1951 | Watson | 252/78 |
| 2,622,066 | 12/1952 | Jehle, Jr. | 252/49.8 |
| 2,656,373 | 10/1953 | Gamrath | 252/49.8 |
| 2,699,429 | 1/1955 | Lowenstein-Lom | 252/49.8 |
| 2,730,499 | 1/1956 | Pokorny | 252/49.8 |
| 2,779,739 | 1/1957 | Spivack | 252/49.8 |
| 3,189,628 | 6/1965 | Knight | 260/403 |
| 3,531,411 | 9/1970 | Benson | 252/32.5 |
| 3,816,311 | 6/1974 | Malec | 252/49.8 |
| 3,816,346 | 6/1974 | Coppock | 252/49.8 |
| 3,891,726 | 6/1975 | Elliott et al. | 252/49.8 |
| 3,970,570 | 7/1976 | Pratt | 252/49.9 |
| 4,033,887 | 7/1977 | De Roocker | 252/49.8 |
| 4,036,769 | 7/1977 | Zipf | 252/48.6 |
| 4,077,892 | 3/1978 | Frangatos | 252/49.8 |
| 4,105,571 | 8/1978 | Shaub | 252/32.7 E |
| 4,199,461 | 4/1980 | Olund | 508/440 |
| 4,587,107 | 5/1986 | Wisniak | 252/49.8 |
| 4,925,581 | 5/1990 | Erickson et al. | 252/49.8 |
| 5,023,312 | 6/1991 | Erickson et al. | 252/49.8 |
| 5,262,074 | 11/1993 | Erickson et al. | 252/49.8 |
| 5,282,989 | 2/1994 | Erickson et al. | 252/49.8 |

FOREIGN PATENT DOCUMENTS 208 478 5/1984 Germany .

WO 92/13973 8/1992 WIPO .

OTHER PUBLICATIONS

Schwartz, *Surface Active Agents*, Interscience Publishers (1994), p. 516.

Pavlovic et al., Czech Patent No. 277269 Dec. 16, 1992 (abstract).

Chen et al., U.S. Patent No. 4,506,057 Mar. 19, 1985 (abstract).

George, German Patent No. DE 1618746 Jul. 22, 1971 (abstract).

Login et al., U.S. Patent No. 4,395,373 Jul. 26, 1983 (abstract).

Hawkins, U.S. Patent No. 4,069,160 Jan. 17, 1978 (abstract).

Emmenegger, EP 121492 Oct. 10, 1992 (abstract).

Kawashima et al., EP 426020 May 8, 1991 (abstract).

Samson et al., U.S. Patent No. 5,252,387 Oct. 12, 1993 (abstract).

Sieb et al., U.S. Patent No. 4,179,445 Dec. 18, 1979 (abstract).

Mueller et al., U.S. Patent No. 4,108,597 Aug. 22, 1978 (abstract).

Babil et al., U.S. Patent No. 4,064,294 Dec. 20, 1977 (abstract).

Farber et al., U.S. Patent No. 3,652,198 Mar. 28, 1972 (abstract).

William Davey; "Extreme Pressure Lubricants"; Sep. 1950; pp. 1841–1846.

Marcheva, E.N.; "Production of White Compressor Oil NKM–40 From Western Siberian Petroleums"; 1984; pp. 11–12; 101: 75489d.

Potanina, V.A.; "Naphthenic Compressor Oil Used in the Production of Polyethylene"; 1978; pp. 22–23; 88:155412b.

*Primary Examiner*—Jerry D. Johnson
*Attorney, Agent, or Firm*—Scully, Scott, Murphy & Presser

[57] ABSTRACT

Improved lubricating oil for high pressure polyethylene compressors contains white mineral oil or synthetic oil blended with oleic acid in an amount less than 15 wt %, and preferably 0.5–5 wt. %, an EP additive such as a phosphorus containing compound made by phosphating mono or diglycerides derived from vegetable oils and having one or two neutralized acid sites, and no more than 1.0 wt. %, and preferably no more than 0.1 wt. %, of an antioxidant of the phenolic type, and a polybutene viscosity builder in the amount necessary to achieve the expected or desired viscosity. The lubricating compressor oil according to the invention has improved lubricity and gives wear protection over the whole range of lubricating regimes including EP conditions.

14 Claims, No Drawings

ETHYLENE COMPRESSOR LUBRICANT CONTAINING PHOSPATE ESTER OF A MONOGLYCERIDE OR DIGLYCERIDE

This application is a continuation, of application number 08/592,622 filed Jan. 26, 1996, now abandoned, which is a continuation of application No. 08/282,975, filed Jul. 29, 1994, now abandoned.

BACKGROUND OF THE INVENTION

1. Field of the Invention

This invention relates to lubricating oils. More specifically, this invention relates to lubricating oils providing the proper wear protection in extreme-pressure (EP) conditions in the situation where a food grade lubricant is required, and particularly for a polyethylene compressor lubricant.

2. Discussion of the Prior Art

It was well known in the lubricating art to provide white oil lubricants for compressors, as is disclosed in W. A. Potanina, E. N. Marcheva, F. G. Sidlyaronok, S. K. Bogdanov, T. P. Ponomareva, E. E. Nazarova, "NKM-40 naphthenic compressor oil used in the production of polyethylene", *Khim. Technol. Topliy Masel*, No. 2 (1978) 22–23; and E. N. Marcheva, W. A. Potanina, G. I. Fuks, "Production of NKM-40 White Oil Compressor Lubricant From the West Siberian Crudes." *Khim. Technol. Topliy Masel*, No. 7 (1984) 11–12.

It was also known in the prior art to provide amounts of oleic acid in white mineral oil for anti-wear protection, such as is disclosed in British Patent No. 1,338,505.

Other additives as viscosity builders and antioxidants were known to be used in polyethylene compressor oils as disclosed in the above-mentioned patent.

Phosphates, phosphites, phosphonates and thiophosphorus compounds have all been used as antiwear, antioxidant and EP additives in processing fluids, hydraulic fluids and other classes of lubricants but not polyethylene compressor oils.

Oils with phosphorus additives were first used in the early 1940's, as is disclosed in U.S. Pat. No. 2,261,047.

Lubricating compositions comprising oil base vehicles and lubricating compositions comprising water base vehicles having phosphorus EP additives are known to the art and are disclosed in German Democratic Republic Patent No. 208,478 to Hartmut et al. This patent discloses emulsions for hot rolling of metals having improved frictional properties incorporating 5 to 15 wt. % of phosphoric acid partial esters.

U.S. Pat. No. 3,531,411 to Benson and Karg describes a water based lubricant, particularly for EP applications in certain metal working operations, containing 0.01 wt. % of an amine salt of an ester selected from the group consisting of mono and di esters and mixtures of phosphoric acid and an adduct of 1 mole of phenol with from about 4 to about 6 moles of ethylene oxide.

Stable esters of phosphorus containing acids such as tricresyl phosphate used as lubricants and hydraulic fluids are disclosed in U.S. Pat. No. 3,816,311 to Malec.

A storage stable lubricating composition is disclosed in U.S. Pat. No. 4,105,571 to Shaub and Waddey, which composition is said to exhibit improved antifriction and antiwear properties. The composition includes a base oil composition with a package of additives containing zinc dihydrocarbyl dithiophosphate.

An antiwear additive mixture said to exhibit good oxidative stability at high temperatures consisting of a mixture of tricresyl phosphate and pentaerythritol monoleate was disclosed in U.S. Pat. No. 3,970,570.

Lubricating compositions containing phosphates as antiwear additives are taught in U.S. Pat. No. 3,816,346 to Coppock. These compositions are said to show improved lubricity and antiwear properties.

Considerations of food grade purity, compatibility with polymerization catalysts (possibility of poisoning the catalyst), proper solubility in white mineral oil and hydrolytic stability as well as compressor metallurgy, limit the choice of EP additives for polyethylene compressor oil to organic phosphorus compounds.

Operations which encounter EP situations are known to occur during the working of a compressor, and a high performance compressor oil must be able to lubricate the equipment also in EP conditions. Although the operating conditions of a piston in a cylinder of the high pressure polyethylene compressor usually assure hydrodynamic or quasihydrodynamic lubrication over most of the stroke, boundary conditions including EP conditions may occur at the ends of the stroke where the velocity is reduced and reverses. This situation is critical and cannot be ignored. There is no prior art disclosure known of the use of EP additives in polyethylene compressor oils.

The art, therefore, desires an ethylene compressor lubrication oil that not only provides lubrication under hydrodynamic and boundary conditions, but exhibits a high level of protection under EP conditions.

SUMMARY OF THE INVENTION

This invention is an ethylene compressor lubricant which contains mineral oil or synthetic oil in combination with limited amounts of carboxylic acid, particularly oleic acid, and EP additive such as phosphorus containing compounds, particularly those made by phosphating mono and di glycerides derived from vegetable oils having one or two acid sites neutralized, in an amount no more than 1.0 wt. %, and preferably no more than 0.1 wt. %, which assures lubricity and gives wear protection under EP conditions. The lubricant composition may further contain limited amounts of other frictional modifiers which complement the antiwear effectiveness of the present composition. Other important additives may include a phenolic antioxidant and a polymeric viscosity builder, particularly, a polybutene.

The proposed composition of the high pressure compressor oil assures better wear protection within the whole range of lubrication conditions. Mineral oil gives protection in the thick film hydraulic lubrication regime. Oleic acid gives lubricity and wear protection in the boundary situations. When the effectiveness of oleic acid as a friction modifier ceases at higher temperatures, the phosphated ester starts to act as the wear protective agent and friction modifier by reacting with the metallic surface under the influence of high contact pressures and high temperatures ("hot spots") allowing chemical reaction to take place and forming a complex film on the surface, assuring lubrication and wear protection under EP conditions.

Phosphated ester additives to the invention besides providing EP performance also act as antioxidants and corrosion inhibitors.

It is therefore a principal object of the present invention to provide an improved lubricant.

It is a further object of the present invention to provide an oil as aforesaid which exhibits improved wear-resistance.

It is still a further object of the present invention to provide an oil with an improved lubricity and wear protection under EP conditions.

It is still a further object of the present invention to provide a method as aforesaid which gives improved lubricity and wear protection.

It is still a further object of the present invention to provide an oil as aforesaid in combination with equipment having copper bearing metal parts.

It is still a further object of the present invention to provide a method as aforesaid which gives improved lubricity and wear protection.

DETAILED DESCRIPTION OF THE INVENTION

In one aspect the present invention is a compressor lubricating oil containing a mineral oil; a carboxylic acid, particularly oleic acid; and a $P_2O_5$ or $POCl_3$ phosphated glyceride.

The phosphated glyceride need be present in an amount of no more than about 1.0 weight percent and preferably in an amount of up to about 0.1 weight percent.

A further optional component in the above composition is a phenolic antioxidant in an amount of from 0.005% to about 8% by weight.

Polybutene polymeric viscosity builder in amounts of about 5% by weight or more may be added to the composition.

The carboxylic acid, by which is meant any saturated or unsaturated, preferably linear, carboxylic acid containing 2 to 60 carbon atoms, may be present in amounts of about 0.25 to 15% by weight, preferably about 1% to 5% by weight, and preferably about 1.5% to 3% by weight.

A typical composition of the present invention is as follows:

| Component | wt. % |
|---|---|
| mineral oil | balance |
| oleic acid | .25 to 15 |
| $P_2O_5$ phosphated glycerides | 0.01 to 1 |
| polyisobutylene viscosity builder | 5 to 30 |
| phenolic antioxidant | 0.005 to 8 |

The above composition represents a mineral or synthetic oil in novel combination with a very limited amount of a combination of operative components such as oleic acid, and phosphated glycerides to provide effective lubrication under the entire range of lubrication conditions including EP. Prior art oil lubricants were not as effective in lubrication and wear protection because they ceased to act under EP conditions.

The most preferred phosphated glycerides are those $P_2O_5$ derived mono and di glycerides having one or two sites neutralized with sodium hydroxide. The phosphated glycerides have an ash content no greater than 14 wt. % and an acid number to pH 9.5 of about 40.

The white mineral oils employed in the compositions of the invention may be of the kind derived by conventional refining techniques from crude sources such as paraffinic crudes, naphthenic crudes or mixed base crudes and are conveniently employed in an amount of from 60% to 98% by weight of the compositions. Suitable white mineral oils are those of a good grade quality, as indicated by having an unsulphonatable residue (ASTM D-483-63) of at least 97%. Preferably, the white mineral oils employed are of the kind having an unsulphonatable residue of the order of from 99% to 100%. The white oils used in the compositions according to the invention should preferably exhibit good color and should generally be fully refined white mineral oils.

Such oils are, for example, those having a water white color of +30 Saybolt and, in addition, are preferably essentially free of carbonizable substances and exhibit low absorption of ultraviolet light in the wave lengths of 2750, 2950 and 3000 Angstroms (ASTM D-2008). The viscosity of the white mineral oils which may be employed in the lubricating compositions of the present invention is preferably in the range of from 150 to 600 S.U.S. at 100° F.

Suitable synthetic oils which can provide the base for the lubricant according to the invention would include polyalphaolefins and polybutenes in the viscosity range of 300 to 2000 S.U.S. at 100° F.

The viscosity builders that can be employed in the composition according to the invention are preferably employed in amounts of from 5% to 40% by weight of the composition. Suitable viscosity builders include polybutenes, such as polybutylenes, polyisobutylenes, and polyisobutenes, and preferably have a molecular weight of between 300 and 30,000. Higher polybutenes are not applicable because of poor mechanical shear stability.

The phenolic antioxidants which can be employed in the lubricating composition of the invention are preferably present in amounts of from 0.01% to 0.1% by weight of the composition. The alkyl and alkoxy substituents may, for example, contain from 1 to 10 carbon atoms and preferably contain from 1 to 5 carbon atoms. Examples of phenolic antioxidants suitable for use in the compositions of the invention include 4-methyl-2, 6-di-t-butylphenol. Preferred antioxidants are orthotertiary alkyl substituted phenols, such as 4-methyl-2, 6-di-t-butylphenol.

The following examples are illustrative of the invention:

EXAMPLES

The following blends were prepared in the conventional manner of blending mineral oils (all amounts are in % by weight):

| | Blend 1 | Blend 2 | Blend 3 |
|---|---|---|---|
| Paraffinic white mineral oil | 100% | 87.2% | 87.8% |
| Oleic Acid | — | 3.0% | 1.5% |
| Phosphated ester | — | — | 0.1% |
| Polymeric viscosity builder | — | 9.7% | 10.5% |
| Phenolic antioxidant | — | 0.1% | 0.1% |

Screening of the effectiveness of antiwear and frictional properties of the improved oil (Blend 3) versus other compressor oils (Blend 1 and 2) was carried out using a 4 Ball Machine test. The test was conducted on a Roxanna Four Ball Wear Test Machine (Brown G. E. Modification). In order to simulate real compressor workings, the metals tested were a tungsten carbide ball and 3 bronze discs, under the following conditions:

| | |
|---|---|
| Temperature | 250° F. |
| Speed | 600 rpm |
| Load Range | 5–180 kg |
| Duration of Test | 30 min. |

Scar diameter and frictional force were measured, and the coefficient of friction was calculated (see Table I). The results presented in Table I demonstrate that wear protection and frictional behavior of the oil of the present invention (Blend 3) is substantially better than that of the related mineral oil lubricating oils (Blend 1 and Blend 2).

TABLE I

| Blend No. | Load kg. | Scar Diam mm | Average Coeff. of Friction for the 5–180 kg load range | Composition wt. % |
|---|---|---|---|---|
| 1 | 5 | 1.50 | 0.0850 | Parafinnic white oil 100% |
| | 10 | 1.60 | | |
| | 20 | 1.65 | | |
| | 40 | 1.70 | | |
| | 60 | 1.80 | | |
| | 120 | 1.90 | | |
| | 180 | 2.00 | | |
| 2 | 5 | 0.75 | 0.0750 | Paraffinic white oil 87.2% |
| | 10 | 0.85 | | Polymeric viscosity builder 9.7% |
| | 20 | 1.05 | | Oleic acid 3.0% |
| | 40 | 1.30 | | Antioxidant phenolic type 0.1% |
| | 60 | 1.55 | | |
| | 120 | 1.95 | | |
| | 180 | 2.10 | | |
| 3 | 5 | 0.68 | 0.0370 | Paraffinic white oil 87.8% |
| | 10 | 0.75 | | Polymeric viscosity builder 10.5% |
| | 20 | 0.80 | | Oleic acid 1.5% |
| | 40 | 1.00 | | Antioxidant phenolic type 0.1% |
| | 60 | 1.15 | | Phosphated ester 0.1% |
| | 120 | 1.55 | | |
| | 180 | 1.86 | | |

What is claimed is:

1. An ethylene compressor lubricating oil comprising:

a mineral or synthetic oil;

a carboxylic acid; and a phosphate ester of a monoglyceride or diglyceride.

2. The lubricating oil of claim 1, wherein the carboxylic acid is oleic acid.

3. The lubricating oil of claim 2, wherein the oleic acid is present in an amount of less than 15% by weight.

4. The lubricating oil of claim 3, wherein the ester is present in an amount of no more than about 1.0% by weight.

5. The lubricating oil of claim 4, wherein the ester is produced by phosphating a vegetable oil glyceride which has had one or two acid sites neutralized with sodium hydroxide.

6. The lubricating oil of claim 1, further comprising a phenolic antioxidant.

7. The lubricating oil of claim 1, further comprising a polymeric viscosity builder.

8. The lubricating oil of claim 1, wherein the ester is produced by phosphating a mixture of mono and di glycerides.

9. A lubricating oil comprising:

a white oil;

1 to 5% by weight of oleic acid; and 0.01 to 1.0% by weight of a phosphate ester of a monoalyceride or diglyceride.

10. The lubricating oil of claim 9, wherein the phosphate ester is produced by phosphating mono and di glycerides derived from vegetable oils having one or two acid sites neutralized with sodium hydroxide.

11. The lubricating oil of claim 9, further comprising from 0.005 to 8 weight % of a phenolic antioxidant.

12. The lubricating oil of claim 9, further comprising a polymeric viscosity builder.

13. The lubricating oil of claim 9, wherein the oleic acid is present in an amount of about 1.5% by weight.

14. A method for lubricating a metal surface subject to EP conditions, comprising:

(a) providing a metal surface for lubrication;

(b) lubricating said surface with an oil comprising: a white mineral oil; oleic acid; and a phosphate ester of a monoglyceride or diglyceride; and (c) subjecting said metal surface and oil to EP conditions.

* * * * *

UNITED STATES PATENT AND TRADEMARK OFFICE

CERTIFICATE OF CORRECTION

PATENT NO. : 5,763,371
DATED : June 9, 1998
INVENTOR(S) : A. Debski-Chwaja, et al.

It is certified that error appears in the above-identified patent and that said Letters Patent is hereby corrected as shown below:

Claim 9, column 6,
Line 18, "monoalyceride" should read -- monoglyceride --

Signed and Sealed this

Eighteenth Day of September, 2001

*Attest:*

Nicholas P. Godici

*Attesting Officer*

NICHOLAS P. GODICI
*Acting Director of the United States Patent and Trademark Office*